United States Patent [19]

Leutheuser

[11] 4,068,801

[45] Jan. 17, 1978

[54] PULSATING JET SPRAY HEAD

[75] Inventor: Harold H. Leutheuser, Hillsdale, Mich.

[73] Assignee: Alson's Corporation, Somerset, Mich.

[21] Appl. No.: 724,117

[22] Filed: Sept. 17, 1976

Related U.S. Application Data

[63] Continuation-in-part of Ser. No. 678,042, April 19, 1976, which is a continuation of Ser. No. 621,376, Oct. 10, 1975, abandoned.

[51] Int. Cl.[2] ..... B05B 1/08

[52] U.S. Cl. ..... 239/102; 239/383; 239/394; 239/469

[58] Field of Search ..... 239/101, 102, 383, 394, 239/382, 468, 469

[56] References Cited

U.S. PATENT DOCUMENTS

| | | | |
|---|---|---|---|
| 3,568,716 | 3/1971 | Heitzman | 239/383 X |
| 3,762,648 | 10/1973 | Deines et al. | 239/383 |
| 3,801,019 | 4/1974 | Trenary et al. | 239/383 |
| 3,940,069 | 2/1976 | Gunzel, Jr. et al. | 239/394 X |
| 3,963,179 | 6/1976 | Tomaro | 239/102 X |

*Primary Examiner*—Robert W. Saifer
*Assistant Examiner*—Michael Mar
*Attorney, Agent, or Firm*—Lyon & Lyon

[57] ABSTRACT

A spray head including a handle disk having an exposed front wall and manually engageable peripheral portion the wall having a set of jet nozzles arranged in a circle, the perforations having common communication with a set of fine spray nozzles; the handle disk being mounted for limited arcuate movement with respect to a housing having a mating perforated wall for exposing the jet nozzles or the perforations communicating with the spray nozzles. The interior of the housing forms a chamber in which water is caused to rotate and drive a rotor having at least one opening which passes intermittently across the jet nozzles or perforations depending on the position of the handle disk. When the jet spray nozzles are activated the effect of the rotor and its slot is to cause the jet nozzles to produce pulsating jets. When the fine spray nozzles are activated, the water entering the perforations is diffused to produce essentially constant flow through the fine spray nozzles.

20 Claims, 12 Drawing Figures

PULSATING JET SPRAY HEAD

This application is a continuation-in-part of application Ser. No. 678,042, filed Apr. 19, 1976; which application is a continuation of application Ser. No. 621,376, filed Oct. 10, 1975, now abandoned, both applications bearing the same title as this application.

BACKGROUND

Various types of spray heads have been provided for showers, which have produced a pulsating spray; for example the spray heads shown in the following U.S. Pat. Nos.: 1,446,887; 1,609,047; 2,878,066; 3,473,736; 3,568,716; 3,713,587 and 3,762,648. Most of the identified patents merely produce only pulsating spray, some however, may be adjusted to provide a steady or a pulsating spray. In such cases the spray head becomes complicated and the adjustment to select the desired spray is sometimes difficult under the conditions of use.

SUMMARY

The present invention is directed to an improvement in pulsating jet shower spray heads and is summarized in the following objects:

First, to provide a spray head which utilizes a novelly arranged peripherally exposed manually engageable handle disk which is readily turned with respect to the spray head housing to produce a course pulsating spray or a steady fine spray.

Second, to provide a spray head in which the water is caused to rotate and drive a novelly arranged rotor having open portions and closed portions which pass in sequence across a ring of jet ports to cause intermittent or pulsating discharge of water therefrom.

Third, to provide a spray head, as indicated in the other objects, wherein the means which produces the fine spray pattern, though exposed to the effect of the rotor movement tends to minimize pulsation, by providing a multiplicity of passageways.

Fourth, to provide a spray head, as indicated in the preceding object, wherein the fine spray passageways are formed by a nesting series of rings, each having a set of peripheral grooves covered by the confronting wall of the next ring, the rings being readily separable for cleaning.

DETAILED DESCRIPTION

Figure 1:
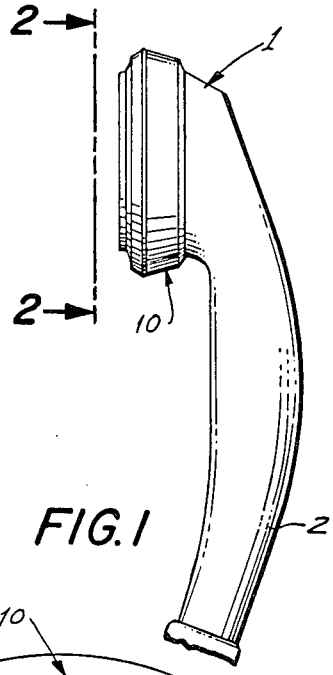
FIG. 1 is a reduced side view of the pulsating jet shower head.

Referring to FIGS. 1 through 5, the pulsating jet spray head includes a housing 1 which in the construction shown in FIG. 1 is provided with a tubular handle 2. The housing forms a chamber 3 having a central mandrel 4 which receives and secures a mounting bolt 5.

The forward side of the chamber 3 is closed by a plate 6 having marginal rim 7 which is heat sealed or otherwise secured to the housing. The plate 6 with a radially inward set of perforations 8 and a radially outward set of perforations 9, in the construction illustrated, each set comprises three perforations.

The plate 6 forms a flat outer surface over which is mounted a handle disk 10 having a wall 11 which confronts the plate 6 and is sealed with respect to the plate by a peripheral seal ring 12. The handle disk includes a marginal rim 13 which projects radially beyond the plate 6 and forward end of the housing 1. The marginal rim 13 also extends forwardly of the wall 11. The rim is provided with appropriate grooves 13*a*, indicated only in FIG. 3, to facilitate grasping and turning the handle disk 10.

The wall 11 is provided with a radially inner set of perforations 14 positioned to align with the perforations 8. The wall 11 is also provided with a set of radially outer perforations 15 positioned to align with the radially outer perforations 9, the perforations 15 forming jet nozzles.

The central portion of the wall 11 encompassing the perforations 8 forms a recessed area 16 having a tapered peripheral wall 17, covering the recessed area 16 are spray disks 18, 19 and 20 which are tapered in conformity to the peripheral wall 17 and are adapted to overlap axially. The outer periphery of each disk is provided with a ring of axially extending grooves 21 whereas the confronting wall is smooth so that the grooves 21 form a concentric ring of spray nozzles.

The mounting bolt 5 extends through the wall 11 and receives an inner nut 22 and washer 23 which clamp the wall 11 against the plate 6 to provide a predetermined degree of resistance of rotation of the handle disk 10 with respect to the housing 1. The mounting bolt 5 also receives an outer nut 24 which engages the radially inner spray disk 20 to secure the spray disks in place.

Figure 2:
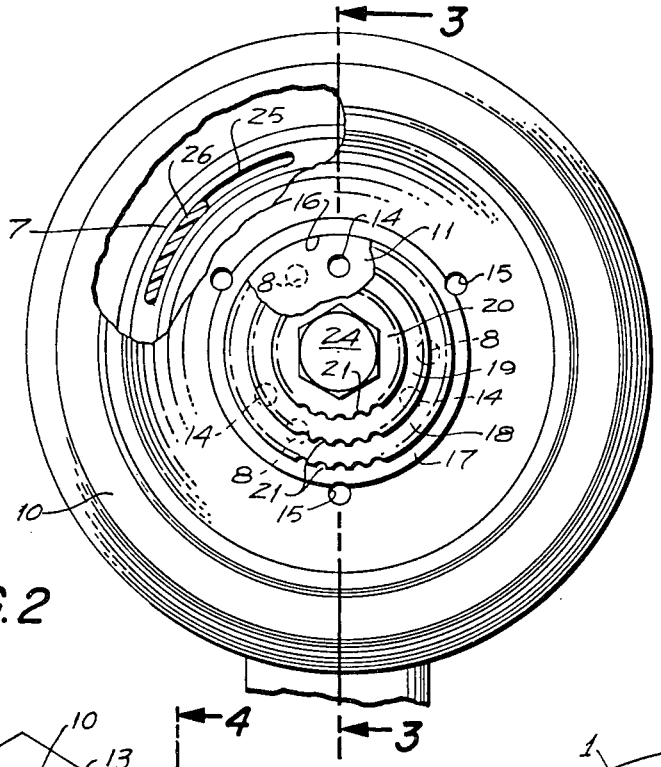
FIG. 2 is an enlarged front view thereof, with the handle shown fragmentarily and with portions indicated in section to show internal construction.

In order to limit rotation of the handle disk 10 with respect to the housing 1, the marginal rim 7 of the plate 6 is provided with an arcuate slot 25 and the corresponding region of the handle disk 10 is provided with an arcuate projection 26 as shown in FIG. 2. Mounted within the chamber 3 is a rotor 27 which includes a base plate 28 having a hub 29 which is loosely journaled on the central mandrel 4 between confronting shoulders 4*a* and 6*a*. The base plate 28 is also joined to a peripheral wall 30 extending in the same direction as the hub 29 and the hub and wall are joined by radiating impeller webs 31.

The base plate is provided with an arcuate perforation 32 radially overlapping the outer perforations 15 and partially overlapping the inner perforations 14. The base plate is preferably arched slightly, curving away from the plate 6. Also the base plate 6 is provided with an annular recess 33 forming with the outer periphery of the base plate 28 and an annular bypass opening. In the construction illustrated in FIGS. 1 through 4, the handle 2 is provided with a supply passage 34 which discharges into the chamber 3 and engages a deflector web 35 to cause the entering water to rotate and on rotating, engage the webs 31 so as to cause the rotor 27 to rotate.

Figure 3:
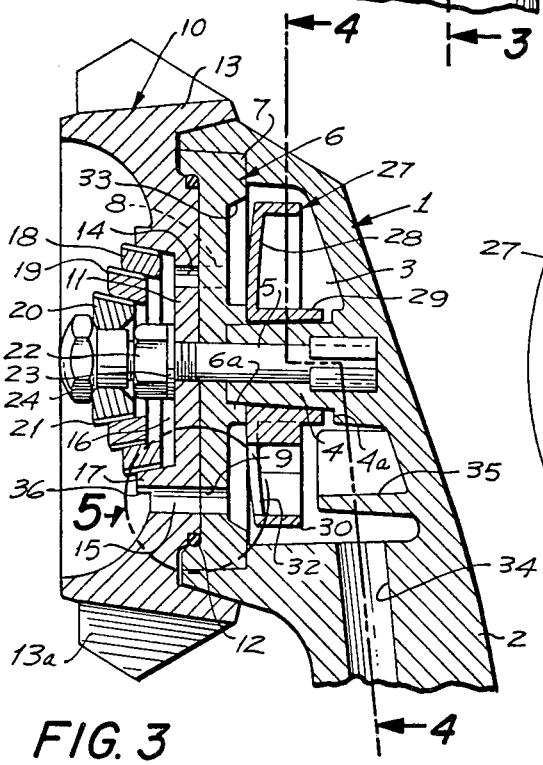
FIG. 3 is a sectional view taken through 3—3 of FIG. 2.
Figure 4:
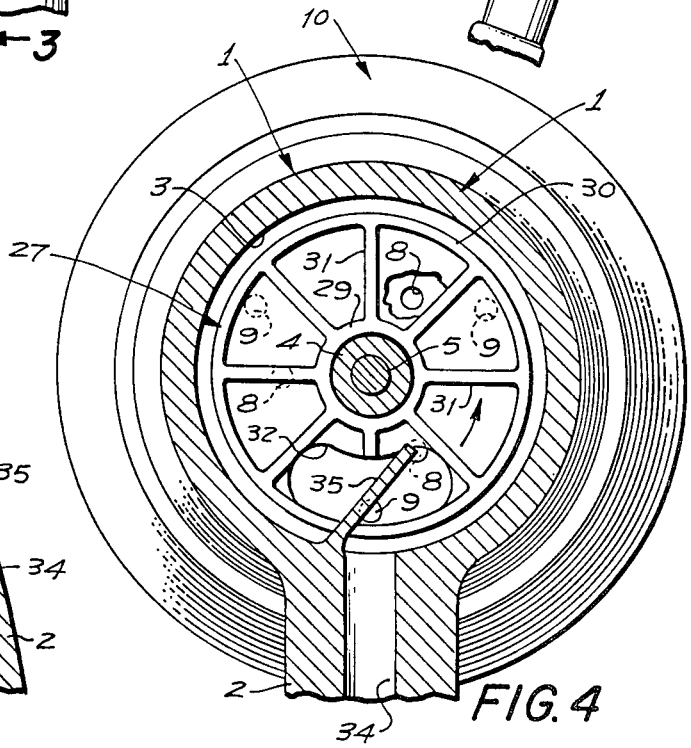
FIG. 4 is a sectional view taken through 4—4 of FIG. 3.

Operation of the embodiment of the pulsating jet spray head shown in FIGS. 1 through 5 is as follows:

When it is desired to use the pulsating jets, the handle disk 10 is set as shown in the drawings, that is, as shown in FIG. 3 the radially outer perforations 9 align with the radially outer or jet perforations 15. Rotation of the rotor 27 causes the arcuate slot 32 to pass the perforations 9 in sequence, permitting the water to pass freely through the slot 32 directly into the aligned perforations 9 and 15, producing a strong jet of water. When the perforations 9 are covered by the base plate 28 direct discharge is cutoff. However, because of the clearance between the rotor 27 and the plate 6, a reduced flow occurs thus while the water jets continuously the force of the jet is increased intermittently.

When the handle disk 10 is turned to connect the perforations 8 and 14, the water discharged into the recessed area 16 and from this recess through the spray grooves 21. While some pulsation may occur, the amount is slight due to flow interference in region behind the disk 18, 19 and 20 and also due to the small size and large number of the grooves 21.

Figure 5:
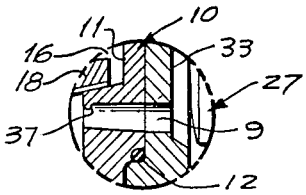
FIG. 5 is a sectional view taken within circle 5 of FIG. 3 showing a modified jet nozzle.

The pattern of the jet sprays depends on the shape of the jet spray nozzles. As shown in FIG. 3, thedischarge ends of the jet orifices may be extended on the radially inner side, as indicated by 36. This produces a slight radially outward diversion and scattering of the jet stream. Also the exit end may have a small internal boss 37 as shown in FIG. 5, to produce the desired deflection. Still further, the jet nozzles may be tapered in either direction. Also the jet streams need not be identical. It can thus be seen that the type and pattern of the jet streams may be prearranged to produce the desired effect.

It will be noted that because of the loose mounting of the rotor some wobbling occurs. This has been found advantageous in causing the jet streams to vary. Also such wobbling motion apparently contributes to damping the pulsations when the discharge is through the spray nozzles formed by the disks 18, 19 and 20.

It will be noted that the handle disk 10 extends radially beyond the housing 1 so that the marginal rim 13 of the handle disk 10 may be readily grasped and turned.

Referring to FIGS. 6 through 9, the embodiment here illustrated includes a modified rotor 38 having a base plate 39, hub 40, peripheral wall 41 and radial ribs 42 similar to the corresponding elements of rotor 27, as is the case with the rotor 27 the webs 42 divide the rotor into eight segments, however inplace of the arcuate perforation 32, six of the eight segments are provided with perforations 43 and the two remaining segments are closed and in addition are covered by an arcuate shallow boss 44, with a short radial extension 45. The rotor 38 is so mounted that the boss 44 extends into close proximity to the rear wall of the plate 6 as indicated in the upper portion of FIG. 6.

Figure 6:
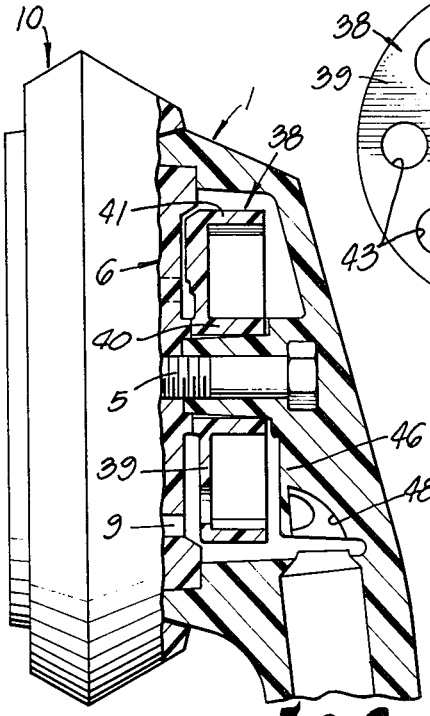
FIG. 6 is an enlarged fragmentary, partially sectional, partially side view corresponding to FIG. 3 showing a modified rotor and rotation inducing jet means.
Figure 8:
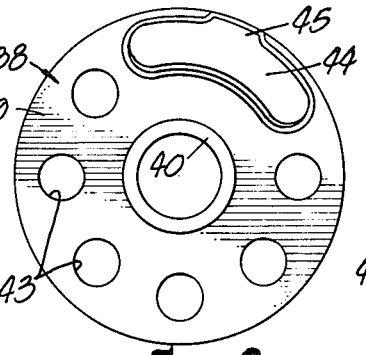
FIGS. 8 and 9 are end views of the modified rotor.
Figure 9:
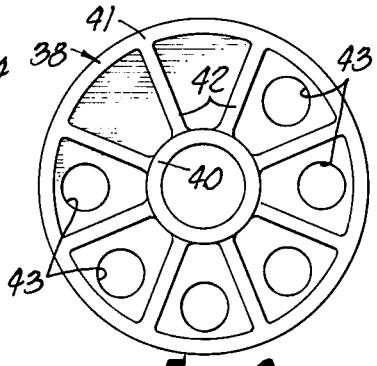
Figure 7:
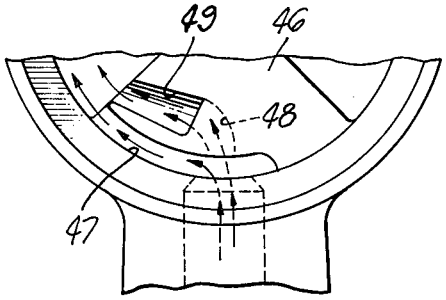
FIG. 7 is a fragmentary sectional view of the modified rotation inducing jet means as formed in the shower head handle.
Figure 10:
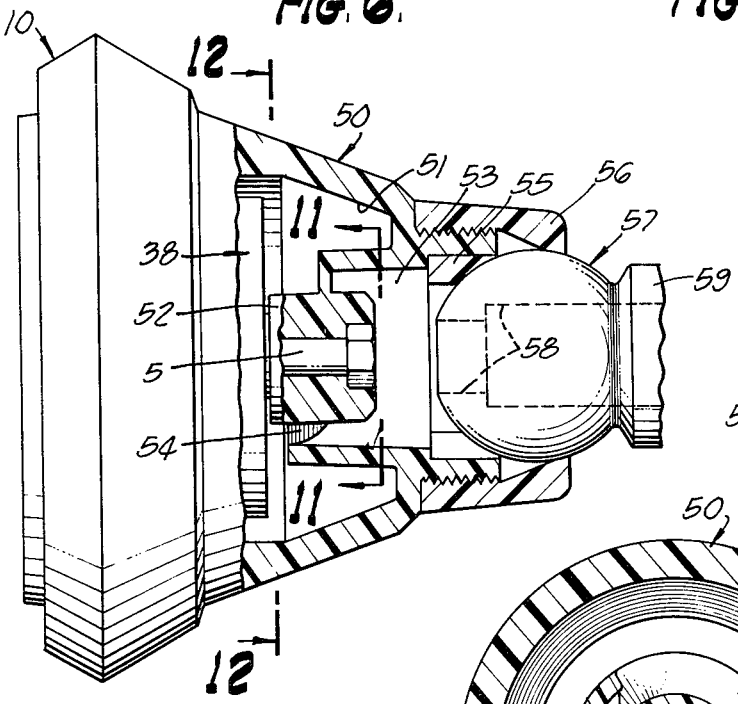
FIG. 10 is an enlarged, fragmentary, partially sectional, partially side view of an embodiment arranged for wall mounting.
Figure 11:
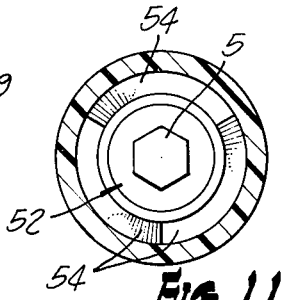
Fig 11 is a transverse sectional view taken through 11—11 of FIG. 10 showing the entrance ends of the rotation inducing jet passageways.
Figure 12:
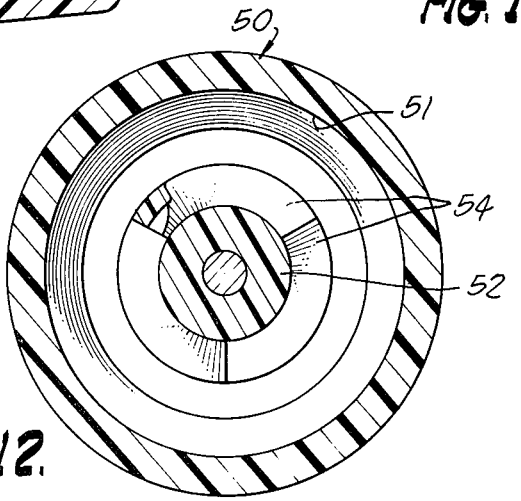
FIG. 12 is a transverse sectional view taken through 12—12 of FIG. 10 showing the exit ends of the rotation inducing jet passageways.

The operation of the rotor 38 differs from the rotor 27 in that the boss 44 and radial extension 45 has minimum clearance with respect to the plate 6, as indicated in FIG. 6. Consequently, flow through only one passage 9 at a time is minimized, while full flow from the other live passages occurs.

In place of the deflector web 35 the modified construction is provided with a raised portion 46 in the bottom of the chamber 3 and arcuate slot 57 is formed between the raised portion 46 and the chamber wall causing the water to rotate or swirl as it passes into chamber 3. Also the raised portion 46 is provided with an elbow passage 34 and the discharge end of which aligns with the tangentially directed flow channel 49, as a result the water rotates in the chamber 3 and engages the webs 42 to maintain rotation of the rotor 38.

The housing 1 is interchangeable with a wall mounted housing 50 having a chamber 51 corresponding to the chamber 3, and a central mandrel 52 corresponding to the central mandrel 4 and arranged to receive a mounting bolt 5. Separated from the chamber 51 by the mandrel 52 is a central inlet chamber 53 directed toward the rotor 38 so as to impinge on the webs 42.

The rearward end of the housing 50 receives a journal ring 55 and a screw threaded mounting ring 56 which engages and seals a journal ball 57 having an inlet passage 58 and a standard fitting 59, shown fragmentarily, arranged for screw threaded attachment to a wall mounted supply tube, not shown.

The reaction of the rotor 38 to the water issuing from the helical passages 54 is essentially the same as the reaction of the rotor to the arcuate slot 47 and tangentially directed flow channel 49.

Having fully described my invention it is to be understood that I am not to be limited to the details herein set forth, but that my invention is of the full scope of the appended claims.

I claim:

1. A shower head comprising:

a. a housing forming a chamber defined in part by a plate having a set of fine spray supply ports, and a set of jet spray supply ports;

b. a peripherally engageable handle disk sealingly confronting and covering the plate, the handle disk having a set of fine spray nozzles and a set of jet nozzles, the handle disk being manually movable arcuately to connect the fine spray supply ports and fine spray nozzles, or to connect the jet spray supply ports with the jet spray nozzles;

c. means for producing a rotating current of water in the chamber;

d. and a rotor driven by the rotating water current, the rotor including a rotatable base plate disposed contiguous to the supply port plate, the base plate having closed and open portions movable past the supply ports in succession to produce at jet spray nozzles a pulsating effect.

2. A shower head as defined in claim 1, wherein:

a. the rotor includes an arcuate slot of such peripheral extent that a minority of the jet spray nozzles are activated in sequence.

3. A shower head as defined in claim 1, wherein:

a. the rotor includes an arcuate closure of such peripheral extent that a majority of the jet spray nozzles are activated in sequence.

4. A shower head as defined in claim 1, wherein:

a. a handle having a water supply passage extends radially from the housing;

b. and the rotating current producing means is a deflector impinged by water issuing from the water supply passage.

5. A shower head as defined in claim 1, wherein:
a. the housing is provided with an axially directed inlet chamber, and includes a set of helical passages forming the rotating current means.

6. A shower head as defined in claim 1, wherein:
a. the fine spray nozzles are distributed over a sufficient area that, when in operation, the pulsating effect is diffused and minimized.

7. A shower head as defined in claim 6, wherein:
a. the rotor base plate in the annular region having the opening, is spaced from the supply port plate to permit a reduced volume of water to bypass the rotor opening and enter the supply ports which are out of registry with the rotor opening.

8. A shower head as defined in claim 1, wherein:
a. the housing is provided with a centered mandrel;
b. the rotor includes, in addition to its base plate, a centered hub journaled on the mandrel, a peripheral wall, and radiating impeller webs extending between the hub and peripheral wall, the rotor being loosely supported to permit a limited wobble motion of the rotor.

9. A shower head as defined in claim 1, wherein:
a. the periphery of the handle disk projects radially beyond the housing for ready manual engagement.

10. A shower head as defined in claim 1, wherein:
a. a set of separable rings each having on one radial side a ring of grooves, its other radial side being smooth, the rings dimensioned to nest and cause the grooves to form the fine spray nozzles.

11. A shower head comprising:
a. a housing forming a chamber having a single water inlet and deflector means adjacent said inlet for causing tangential deflection and rotation of water therein, a discharge plate having a ring of discharge ports, and a mandrel;
b. a rotor including a hub journaled on the mandrel, a peripheral wall, radiating impeller webs joining the hub and wall, and a base disk also joining the hub and wall and confronting the discharge plate, a preselected arcuate portion of the rotor base disk having at least one opening and a complementary arcuate portion being closed whereby a preselected number of discharge ports are exposed and closed in sequence;
c. a set of jet nozzles for the discharge ports adapted as the rotor slot passes the discharge ports to produce intermittent jets of water;
d. a set of spray nozzles including pulsation damping means;
e. and a manually operable control means for selectively connecting the jet nozzles or the spray nozzles with the discharge ports.

12. A shower head as defined in claim 11, wherein:
a. the closed portion of the rotor base disk is in close relation to the discharge plate to permit reduced passage of water to those jet nozzles covered by the closed portion of the rotor base disk.

13. A shower head as defined in claim 12, wherein:
a. the rotor is loosely mounted to permit a limited wobbling movement varying the discharge jet pattern.

14. A shower head as defined in claim 11, wherein:
a. the housing is attached to a handle having a water supply passage;
b. and the water rotating means is a deflector blade.

15. A shower head as defined in claim 11, wherein:
a. the housing includes an inlet coaxial with the chamber;
b. and the water rotating means includes a coaxial ring of helical deflecting surfaces.

16. A shower head comprising:
a. a housing forming a chamber having a single water inlet and deflector means adjacent said inlet for causing tangential deflection and rotation of water therein, a discharge plate having a ring of discharge ports, and a mandrel;
b. a rotor including a hub journaled on the mandrel, a peripheral wall, radiating impeller webs joining the hub and wall, and a base disk also joining the hub and wall and confronting the discharge plate, a preselected arcuate portion of the rotor base disk having at least one opening and a complementary arcuate portion being closed whereby a preselected number of discharge ports are exposed and closed in sequence;
c. a set of jet nozzles for the discharge ports adapted as the rotor slot passes the discharge ports to produce intermittent jets of water;
d. a handle disk overlying the discharge plate, and including a portion in sealing engagement therewith, penetrated by the jet nozzles;
e. the handle disk also including a set of spray nozzles disposed centrally of the jet nozzles;
f. the handle disk being arcuately movable to shut off the jet nozzles and connect the spray nozzles to the housing chamber.

17. A shower head as defined in claim 16, wherein:
a. the handle disk extends radially beyond the housing to provide a readily engageable periphery for shifting the handle disk to select the spray nozzles or jet nozzles.

18. A shower head as defined in claim 16, wherein:
a. the set of spray nozzles include concentric ring elements of different diameters having tapered surfaces adapted to fit in axially overlaping relation to form concentric rings of spray nozzles.

19. A shower head as defined in claim 11, wherein:
a. the relative arcuate extent of the open and closed portions of the base disk being proportioned to activate a minority of the jet nozzles in sequence.

20. A shower head as defined in claim 11, wherein:
a. the relative arcuate extent of the open and closed portions of the base disk being proportioned to activate a majority of the jet nozzles in sequence.

* * * * *